US010865624B1

(12) United States Patent
Cui et al.

(10) Patent No.: US 10,865,624 B1
(45) Date of Patent: Dec. 15, 2020

(54) WELLSITE SYSTEM FOR ELECTRIC DRIVE FRACTURING

(71) Applicant: YANTAI JEREH PETROLEUM EQUIPMENT & TECHNOLOGIES CO., LTD., Yantai (CN)

(72) Inventors: Shuzhen Cui, Yantai (CN); Rikui Zhang, Yantai (CN); Sheng Chang, Yantai (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

(21) Appl. No.: 16/838,787

(22) Filed: Apr. 2, 2020

(30) Foreign Application Priority Data

Sep. 24, 2019 (CN) ..... 2019 1 0904510

(51) Int. Cl.
*E21B 43/26* (2006.01)
*E21B 41/00* (2006.01)
*F04B 17/03* (2006.01)

(52) U.S. Cl.
CPC ..... *E21B 41/0085* (2013.01); *E21B 43/2607* (2020.05); *F04B 17/03* (2013.01)

(58) Field of Classification Search
CPC ... E21B 43/26; E21B 43/2607; E21B 41/0085
See application file for complete search history.

(56) References Cited

U.S. PATENT DOCUMENTS

2014/0096974 A1* 4/2014 Coli ..... B01F 7/00008 166/358
2014/0138079 A1* 5/2014 Broussard ..... E21B 43/26 166/66.4
2014/0251623 A1* 9/2014 Lestz ..... E21B 43/267 166/308.2
2016/0208592 A1* 7/2016 Oehring ..... F04D 29/669

* cited by examiner

*Primary Examiner* — D. Andrews

(57) ABSTRACT

The present invention discloses a wellsite system for electric drive fracturing, including a gas source, a power supply system, electric drive fracturing equipments, electric drive sand blenders, a sand supply equipment, a liquid supply equipment, instrumentation, and two high-low pressure manifolds, wherein the power supply system is a gas turbine generator set, the gas source provides fuel for the gas turbine generator set, the gas turbine generator set provides power for the electric drive fracturing equipments and the electric drive sand blenders respectively, the sand supply equipment and the liquid supply equipment are both connected to input ends of the electric drive sand blenders, output ends of the electric drive sand blenders are connected to the electric drive fracturing equipment through one high-low pressure manifold, the electric drive fracturing equipments are connected to a wellhead through the other high-low pressure manifold, the instrumentation is used for remote control of the electric drive fracturing equipments and the electric drive sand blenders.

9 Claims, 3 Drawing Sheets

WELLSITE SYSTEM FOR ELECTRIC DRIVE FRACTURING

TECHNICAL FIELD

The present invention relates to the technical field of fracturing in oil and gas fields, and specifically to a wellsite system for electric drive fracturing.

BACKGROUND

In the working sites of fracturing in oil and gas fields all over the world, the configuration mode for the power transmission system used in conventional fracturing equipment is that a diesel engine is connected to a transmission through a transmission shaft to drive the fracturing plunger pump to work. In other words, a diesel engine is used as the power source, a transmission and a transmission shaft are used as the transmission devices, and a fracturing plunger pump is used as the actuating element. This configuration mode has the following disadvantages: (1) large volume and heavy weight: when a diesel engine drives a transmission to drive a fracturing plunger pump through a transmission shaft, a large volume is occupied, a heavy weight is involved, the transportation is restricted, and the power density is low. (2) Environmental problems: during operations on a well site, the fracturing equipment driven by the diesel engine would generate engine waste gas pollution and noise pollution. The noise exceeding 105 dBA will severely affect the normal life of nearby residents. (3) Cost inefficiency: the fracturing equipment driven by the diesel engine requires relatively high initial purchase costs and incurs high fuel consumption costs for unit power during operation, and the engine and the transmission also require very high routine maintenance costs. (4) The well site layout covers a large area. Efforts are made globally to manufacture oil and gas exploitation equipment with "low energy consumption, low noise, and low emission". Therefore, the foregoing disadvantages of the conventional fracturing equipment that uses the diesel engine as the power source impedes the exploitation progress of unconventional oil and gas sources to some extent.

SUMMARY

To overcome the deficiencies in the prior art, an objective of the present invention is to provide a wellsite system for electric drive fracturing, in which an electric drive fracturing equipment and an electric drive sand blender are employed, a gas turbine generator set is used as the power supply system, and fracturing equipment using diesel engine as the power source is replaced. The gas turbine generator uses natural gas as fuel, the gas sources of which are diverse and not limited, thus better meeting the actual needs of more customers. The gas turbine generator set of the entire wellsite system has a more compact structure and occupies a small area, and the wiring is simple. The electric drive fracturing equipment of the entire wellsite system greatly improve the output power of fracturing equipment, thus better satisfying usage requirement. The electric drive sand blender of the entire wellsite system compresses the overall size of the sand blender effectively, so that the equipment transportation and wellsite layout could be more flexible and convenient, meanwhile optimizing the configuration of the electric motor and the configuration of power system of the sand blender. Compared with traditional fracturing mode driven by diesel engine, the entire wellsite system has lower fuel cost, occupies a smaller area, has a higher power density, a higher output power, and low noise.

The objective of the present invention is achieved by the following technical measures: a wellsite system for electric drive fracturing, including a gas source, a power supply system, electric drive fracturing equipments, electric drive sand blender, a sand supply equipment, a liquid supply equipment, instrumentation, and two high-low pressure manifolds, the power supply system is a gas turbine generator set, the gas source provides fuel for the gas turbine generator set, the gas turbine generator set provides power for the electric drive fracturing equipment and the electric drive sand blenders respectively, the sand supply equipment and the liquid supply equipment are both connected to input ends of the electric drive sand blenders, an output end of the electric drive sand blenders are connected to the electric drive fracturing equipments through one high-low pressure manifold, the electric drive fracturing equipments are connected to wellhead through the other high-low pressure manifold, and the instrumentation is used for remote control of the electric drive fracturing equipment and the electric drive sand blenders.

Further, the gas turbine generator set includes one gas turbine engine, one generator, multiple rectifying units and multiple inversion units. One end of the generator is connected to the gas turbine engine, the other end of the generator is connected to the rectifying units. The multiple rectifying units are arranged side by side. The rectifying units and the inversion units are connected through a common DC bus. The generator is a double-winding generator.

Further, the gas turbine generator set is loaded on a semi-trailer, and the inversion units are disposed on a gooseneck of the semi-trailer body.

Further, the electric drive fracturing equipments are loaded on semi-trailers, there are two electric motors and two plunger pumps in the electric drive fracturing equipment loaded on each semi-trailer, and each electric motor drives one plunger pump.

Further, the power of the plunger pump is 5000 hp or above, and its stroke is 10" or above.

Further, the electric drive sand blender each includes a discharge centrifugal pump, a suction centrifugal pump, a first electric motor and a second electric motor. The first electric motor drives the discharge centrifugal pump, and the second electric motor drives the suction centrifugal pump.

Further, the first electric motor and the second electric motor are variable frequency integrated electric motors.

Further, the gas source is at least one of CNG, LNG, wellhead gas, and pipeline gas.

Compared with the prior art, the present invention has the following beneficial effects: 1. the gas sources are diverse and not limited, thus better meeting the actual needs of more customers. 2. In the power supply system, a combination of one gas turbine engine, one generator and multiple rectifying units are employed, the generator outputs a winding configuration and a voltage required for the rectifying units directly to obviate conventional rectifier transformer equipment. The rectifying units and the inversion units are connected through a common DC bus, so that the common DC bus can separately drive multiple inversion units, thus decreasing the wirings of power supply lines. A high voltage inversion unit is disposed on a gooseneck of the electric drive semi-trailer to optimize the spatial arrangement of equipment. The entire power supply equipment has a more compact structure, occupies a small area, and is simple in wiring. 3. The entire electric drive fracturing equipment adopts a design of double pumps driven by double electric motors, thereby significantly improving the output power of the fracturing equipment and better satisfying the usage requirement. 4. Two variable frequency integrated electric motors are used in the electric drive sand blender to first effectively decrease the configuration of independent frequency conversion cabinet, i.e, the overall size of the sand blender is effectively compressed so that the equipment transportation and wellsite layout could be more flexible and convenient. Secondly, the two electric motors drive the discharge centrifugal pump and other components of the sand blender other than the discharge centrifugal pump, effectively optimizing the configuration of the electric motor and the configuration of power system of the sand blender.

The present invention will be described in detail below with reference to the accompanying drawings and specific implementations.

Wherein, 1. natural gas port, 2. power supply system, 3. electric drive fracturing equipment, 4. electric drive sand blender, 5. sanding vehicle, 6. sand storage tank, 7. Sand conveyor equipment, 8. chemical additive equipment, 9. liquid storage tank, 10. instrumentation, 11. high-low pressure manifold, 12. power supply semi-trailer body, 13. gas turbine engine, 14. generator, 15. rectifying unit, 16. semi-trailer body, 17. plunger pump, 18. radiator, 19. Electrical control cabinet, 20. fracturing electric motor, 21. fracturing inversion unit, 22. the first electric motor, 23. the second electric motor, 24. discharge centrifugal pump, 25. suction centrifugal pump, 26. mixing tank, 27. dry additive system, 28. liquid additive system, 29. sand auger system, 30. blending equipment, 31. wellhead, 32. natural gas processing equipment, 33. common DC bus, 34. gooseneck, 35. input end, 36. sand supply equipment, 37. liquid supply equipment.

DESCRIPTION OF THE EMBODIMENTS

Figure 1:
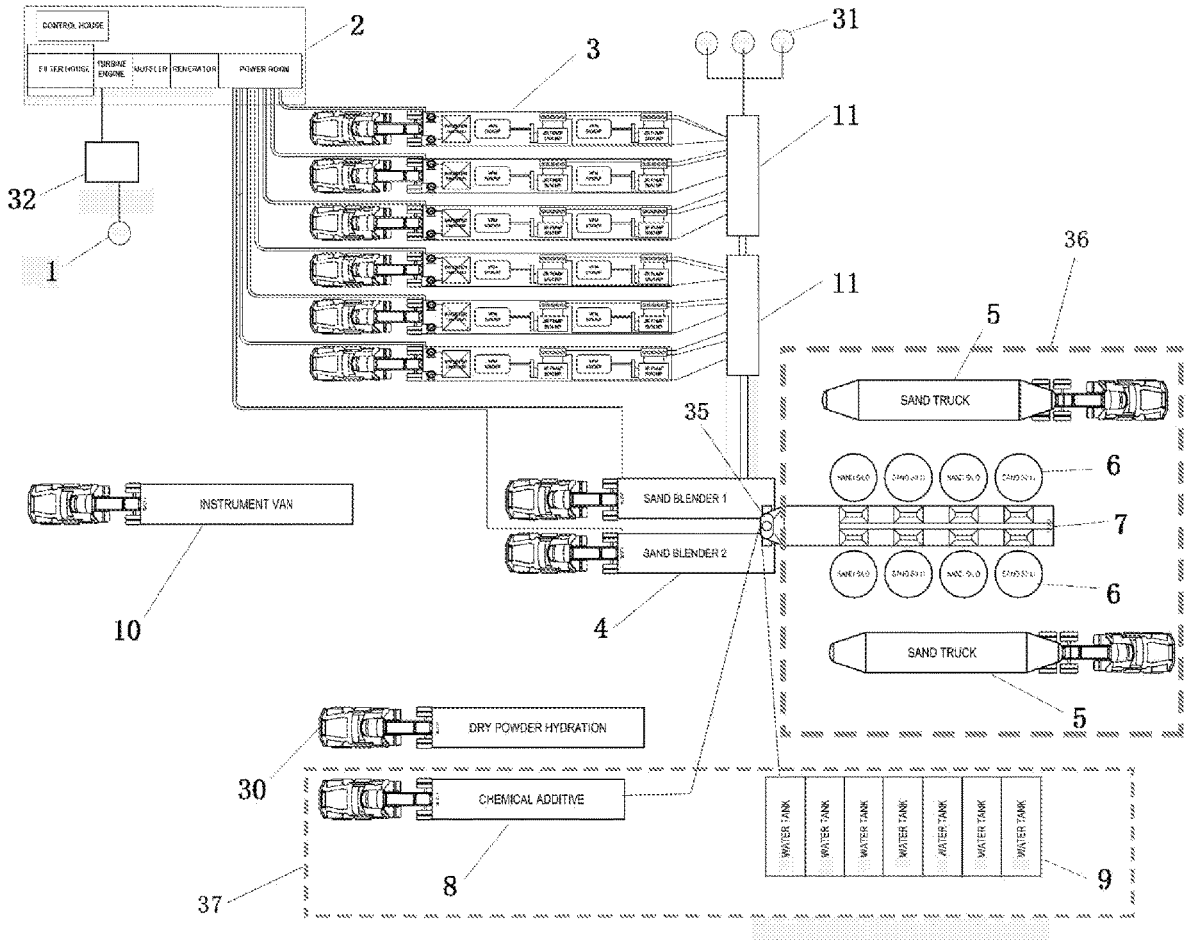
FIG. 1 is a schematic structural diagram of a wellsite system for electric drive fracturing.

As shown in FIG. 1, a wellsite system for electric drive fracturing, including a gas source, a power supply system 2, electric drive fracturing equipments 3, electric drive sand blenders 4, a sand supply equipment, a liquid supply equipment, instrumentation 10, and two high-low pressure manifolds 11, the power supply system 2 is a gas turbine generator set, in which natural gas is used instead of diesel to realize the central supply of electric power. The gas source provides fuel for the gas turbine generator set, the gas turbine generator set provides power for the electric drive fracturing equipments 3 and the electric drive sand blenders 4 respectively. The sand supply equipment and the liquid supply equipment are both connected to input ends of the electric drive sand blenders 4, output ends of the electric drive sand blenders 4 are connected to the electric drive fracturing equipments 3 through one high-low pressure manifold 11. The electric drive fracturing equipment 3 is connected to wellhead 31 through the other high-low pressure manifold 11, and the instrumentation 10 is used for remote control of the electric drive fracturing equipments 3 and the electric drive sand blenders 4. Compared with traditional fracturing mode driven by diesel engine, the entire wellsite system has lower fuel cost, occupies a smaller area, has a higher power density, a higher output power, and low noise. The sand supply equipment includes a sanding vehicle 5, a sand storage tank 6, and a sand conveyor equipment 7. The liquid supply equipment includes a chemical additive equipment 8, a blending equipment 30 and a liquid storage tank 9.

The gas turbine generator set includes one gas turbine engine 13, one generator 14, multiple rectifying units 15 and multiple inversion units. One end of the generator 14 is connected to the gas turbine engine 13, the other end of the generator 14 is connected to the rectifying unit 15. The multiple rectifying units 15 are arranged side by side. The rectifying units 15 and the inversion units are connected through a common DC bus, and the generator 14 is a double-winding generator. The gas turbine generator set is loaded on a semi-trailer, the power supply inversion units are disposed on a gooseneck of the semi-trailer body 16. The power of the generator 14 is not lower than 30 MW. A combination of one gas turbine engine 13, one generator 14 and multiple rectifying units 15 is employed, the generator 14 outputs a winding configuration and a voltage required for the rectifying units 15 directly to obviate conventional rectifier transformer equipment. The rectifying units 15 and the inversion unit are connected through a common DC bus, so that the common DC bus can separately drive multiple inversion units, thus decreasing the wirings of power supply lines. Power supply inversion units are disposed on a gooseneck of the semi-trailer body 16 to optimize the spatial arrangement of equipment. The entire power supply equipment has a more compact structure, occupies a small area, and is simple in wiring.

The generator 14 and rectifying units 15 are highly integrated on a power supply semi-trailer body 12, which, after rectification, outputs DC voltage onto the electric drive fracturing equipment 3. The DC voltage is inverted by the inversion units on the electric drive fracturing equipment 3 to drive the electric motor directly, saving the investment on transformer equipment, and realizing that a single power supply semi-trailer can drive at least three electric drive fracturing semi-trailer. Just because there is no need for transformers, the occupied area and weight of a complete set of fracturing equipment as well as the investment cost of the equipment are further reduced.

The electric drive fracturing equipments 3 are loaded on a semi-trailers. There are two electric motors and two plunger pumps 17 in the electric drive fracturing equipment 3 loaded on each semi-trailer, and each electric motor drives one plunger pump 17. The plunger pump 17 is driven by an electric motor, instead of being driven by an engine and a transmission. A design of double plunger pumps driven by double electric motors is adopted on each semi-trailer, significantly improving the power density of single equipment, reducing the wellsite layout difficulty and improving the transport convenience. The power of the plunger pump 17 is 5000 hp or above, its stroke is 10" or above, thus greatly improving the output power of the entire electric drive fracturing equipment 3, so as to better satisfy usage requirement.

The electric drive sand blenders 4 each includes a discharge centrifugal pump 24, a suction centrifugal pump 25, a first electric motor 22 and a second electric motor 23, the first electric motor 22 drives the discharge centrifugal pump 24, and the second electric motor 23 drives the suction centrifugal pump 25. The discharge centrifugal pump 24 of the electric drive sand blender 4 is directly driven by one electric motor to improve the liquid supply pressure and displacement of the electric drive sand blender 4.

The first electric motor 22 and the second electric motor 23 are variable frequency integrated electric motors.

The electric drive sand blenders 4 are loaded on semi-trailers.

The gas source is at least one of CNG, LNG, wellhead gas, and pipeline gas. The gas sources are diverse and not limited, thus better meeting the actual needs of more customers. The at least one of CNG, LNG, wellhead gas, and pipeline gas is accessed through a natural gas port 1, processed by the natural gas processing equipment 32, and then delivered to power supply equipment.

Figure 2:
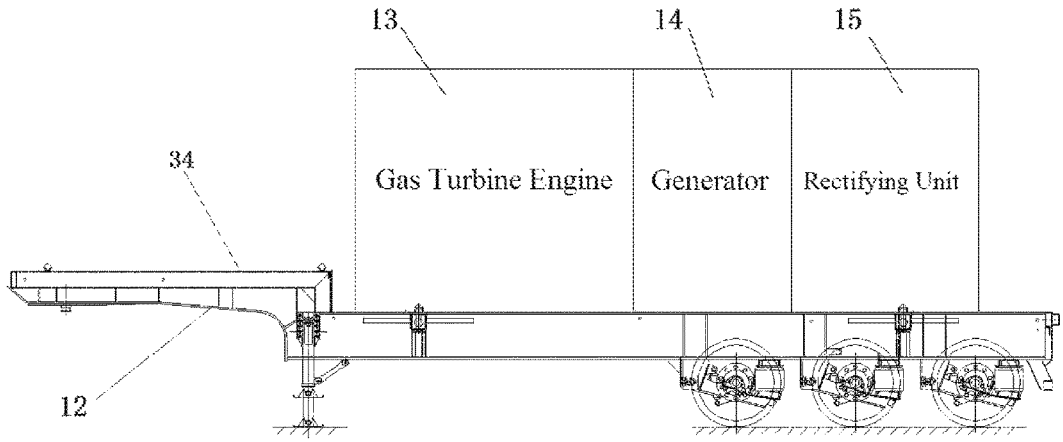
FIG. 2 is a schematic structural diagram of a power supply system.

FIG. 2 is a schematic structural diagram of a power supply system. The gas turbine generator set is loaded on a semi-trailer, which is referred as a gas power supply semi-trailer for short below. The gas power supply semi-trailer includes a power supply semi-trailer body 12, a gas turbine engine 13, a generator 14, a rectifying unit 15 and a power supply inversion unit. The gas turbine engine 13, the generator 14 and the rectifying unit 15 are integrated on the power supply semi-trailer body 12. There is one gas turbine engine 13, one generator 14, and multiple sets of rectifying units 15. One end of the generator 14 is connected to the gas turbine engine 13, the other end of the generator 14 is connected to the rectifying units 15, the multiple sets of rectifying units 15 are arranged side by side. Power supply inversion units are disposed on a gooseneck of the semi-trailer body 16. There are multiple sets of power supply inversion units, the rectifying units 15 and the power supply inversion units are connected through a common DC bus. The generator 14 is a double-winding generator. The generator 14 outputs a winding configuration and a voltage required for the rectifying units 15. The phase difference of double winding of the generator 14 is 30°, and the winding configuration is type Y-Y or type D-D. The alternating voltage output from the generator 14 ranges from 1600 VAC to 2300 VAC.

The power of the generator 14 is 10 MVA or above, the frequency is 50-60 Hz or 100-120 Hz, and the voltage of the rectifying unit 15 is 4000 VDC or above, and further the voltage of the rectifying unit 15 ranges from 4000 VDC to 6500 VDC, ensuring that the gas power supply semi-trailer has a high output power to drive a high-power electric drive fracturing equipment 3.

Figure 3:
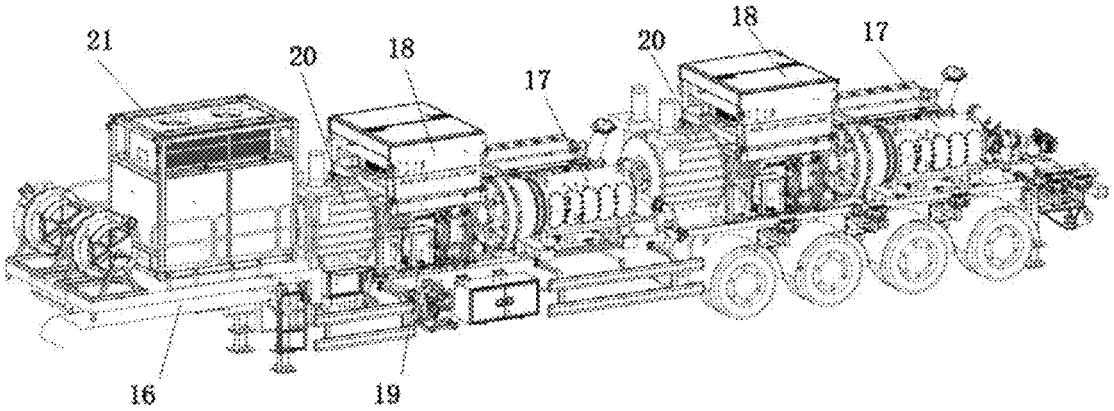
FIG. 3 is a schematic structural diagram of an electric drive fracturing equipment.

FIG. 3 is a schematic structural diagram of an electric drive fracturing equipment. The electric drive fracturing equipments 3 are loaded on semi-trailers. Each semi-trailer loaded with an electric drive fracturing equipment 3 is referred as an electric drive fracturing semi-trailer for short below. Each electric drive fracturing semi-trailer includes a semi-trailer body 16, a plunger pump 17, a radiator 18, an electrical control cabinet 19, a fracturing electric motor 20 and a fracturing inversion unit 21, wherein the plunger pump 17, the radiator 18, the electrical control cabinet 19, the fracturing electric motor 20 and the fracturing inversion unit 21 are integrated on a semi-trailer body 16. The number of axles of the semi-trailer body 16 is 4 or above. The fracturing inversion unit 21 is disposed on a gooseneck of the semi-trailer body 16, one end of the fracturing electric motor 20 is connected to the fracturing inversion unit 21, and the other end of the fracturing electric motor 20 is connected to the plunger pump 17. The radiator 18 cools the lubricating oil of the plunger pump 17. The electrical control cabinet 19 is used to implement local manipulation of the electric drive fracturing semi-trailer. There are two fracturing electric motors 20, two plunger pumps 17, and two radiators 18. The electric drive fracturing semi-trailer of the invention is properly provided with fracturing electric motors 20 and plunger pumps 17, so that there are two fracturing electric motors 20 and two plunger pumps 17 mounted on one semi-trailer. The plunger pump 17 is a five cylinder plunger pump with a stroke of 10" or above, the total power of double pumps can up to 10000 hp. The plunger pumps 17 are derived by the fracturing electric motors 20 instead of being driven by an engine and a transmission. More than one electric drive fracturing semi-trailer can be arranged as needed in fracturing site.

Figure 4:
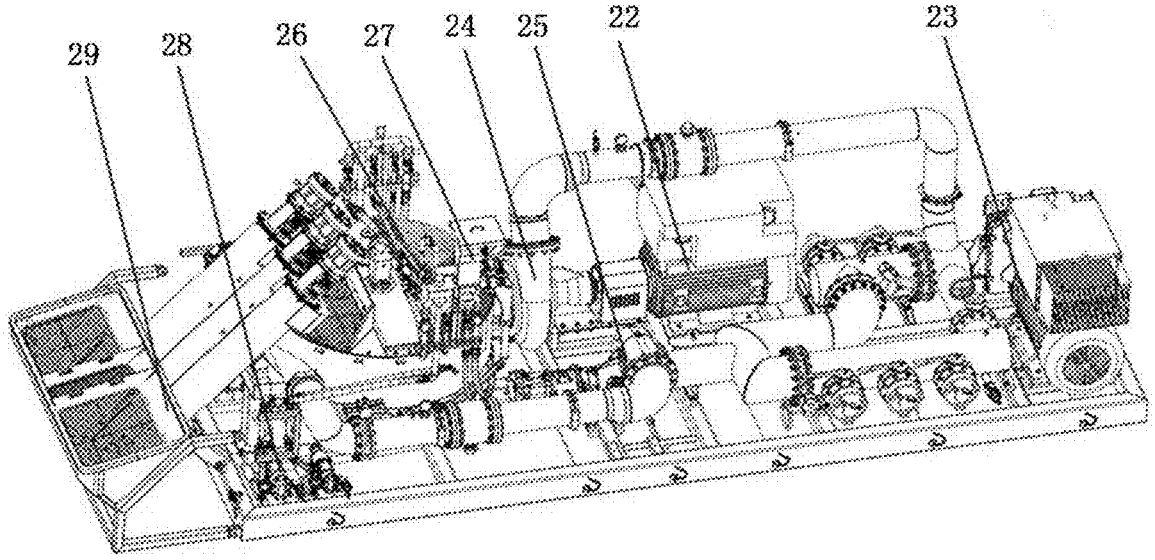
FIG. 4 is a schematic structural diagram of an electric drive sand blender.
Figure 5:
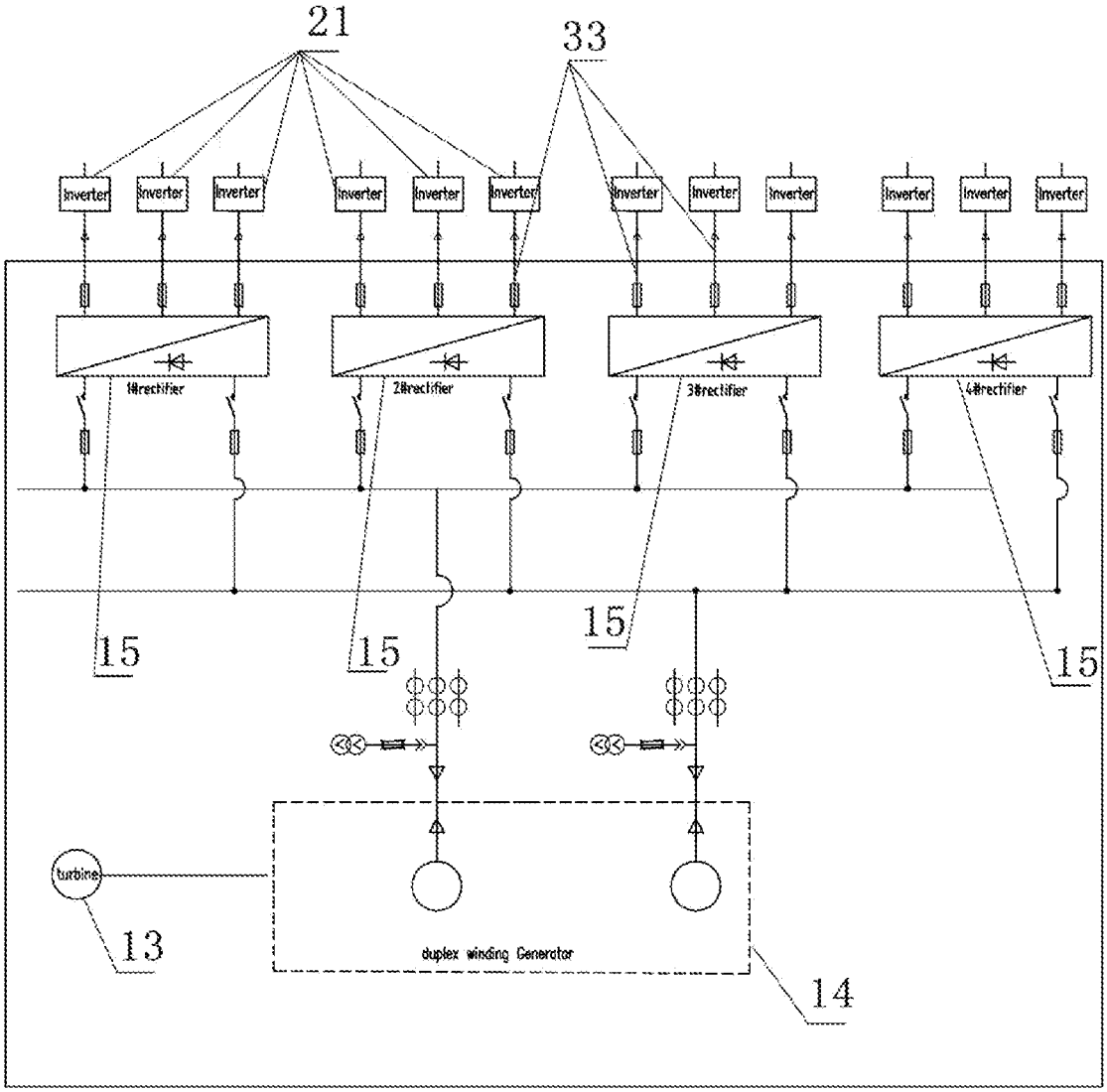
FIG. 5 is a schematic diagram of electrical connection.

FIG. 4 is a schematic structural diagram of an electric drive sand blender. The electric drive sand blenders 4 are loaded on semi-trailers. The semi-trailers loaded with electric drive sand blenders 4 are referred as electric drive sand-blending semi-trailers for short below. Specifically, FIG. 4 shows a schematic structural diagram of the uploading components of the electric drive sand blenders 4 after removing the semi-trailer. More than one electric drive sand-blending semi-trailers can be arranged in the wellsite system, which are in working state or ready for use, to ensure unceasing sand-blending field operation. The electric drive sand-blending semi-trailers each includes a sand-blending semi-trailers body, a sand-blending electric motor, a hydraulic pump, a discharge centrifugal pump 24, a suction centrifugal pump 25, a mixing tank 26, a dry additive system 27, a suction manifold, a discharge manifold, a liquid additive system 28 and a sand auger system 29, wherein the sand-blending electric motor, the hydraulic pump, the discharge centrifugal pump 24, the suction centrifugal pump 25, the mixing tank 26, the dry additive system 27, the suction manifold, the discharge manifold, the liquid additive system 28 and the sand auger system 29 are integrated on the sand-blending semi-trailers body. There are two sand-blending electric motors, including a first electric motor 22 and a second electric motor 23. The first electric motor 22 is used to drive the discharge centrifugal pump 24 directly to conveniently and effectively enhance the input power of the discharge centrifugal pump 24, further improving the operation capability of the equipment. The second electric motor 23 drives the hydraulic pump through a transfer case, and further drives the suction centrifugal pump 25, the mixing tank 26, the dry additive system 27, the liquid additive system 28 and the sand auger system 29. The sand-blending electric motor is a variable frequency integrated electric motor. A variable frequency integrated electric motor (that is, integrating an inversion function on the electric motor) is used to avoid the problem of complex structure and large occupied area of the diesel engine system, and meanwhile decrease the configuration of independent frequency conversion cabinet. Two variable frequency integrated electric motors are used to control all components of the entire electric drive sand blender 4, so that the control system become more concise. During operations, the second electric motor 23 which drives the hydraulic pump can be set to a constant speed directly, it is only needed to adjust the speed of each functional component as necessary in the process of operation to achieve the control purpose.

Operating principle: the liquid storage tank 9 provides water for the blending equipment 30, in which water and various additives are blended to form a fracturing base fluid, and the fracturing base fluid is supplied to the electric drive sand blender 4. The sanding vehicle 5 transports fracturing proppants to the wellsite, which are then conveyed into the sand storage tank 6. There may be multiple sanding vehicles 5. The fracturing proppants are conveyed through a sand conveyor equipment 7 from the sand storage tank 6 to the electric drive sand blender 4. The fracturing base fluid and the fracturing proppants are mixed in the electric drive sand blender 4 and conveyed into the high-low pressure manifold 11, then distributed to each electric drive fracturing semi-trailer through the high-low pressure manifold 11. The electric drive fracturing semi-trailer injects the mixed fracturing fluid into the wellhead 31 by a high-pressure pump (injection path: electric drive fracturing semi-trailer—connection pipeline—high-low pressure manifold 11—wellhead 31), and then the stratum of the oil well or gas well is fractured. The chemical additive equipment 8 is used to supply various chemical additives to the blending equipment 30 or the electric drive sand blender 4.

It will be appreciated to persons skilled in the art that the present invention is not limited to the foregoing embodiments, which together with the context described in the specification are only used to illustrate the principle of the present invention. Various changes and improvements may be made to the present invention without departing from the spirit and scope of the present invention. All these changes and improvements shall fall within the protection scope of the present invention. The protection scope of the present invention is defined by the appended claims and equivalents thereof.

What is claimed is:

1. A wellsite system for electric drive fracturing, comprising a gas source, a power supply system, electric drive fracturing equipments, electric drive sand blenders, a sand supply equipment, a liquid supply equipment, instrumentation, two high-low pressure manifolds, wherein the power supply system is a gas turbine generator set, the gas source provides fuel for the gas turbine generator set, the gas turbine generator set provides power for the electric drive fracturing equipments and the electric drive sand blenders respectively, the sand supply equipment and the liquid supply equipment are both connected to input ends of the electric drive sand blenders, output ends of the electric drive sand blenders are connected to the electric drive fracturing equipments through one high-low pressure manifold, the electric drive fracturing equipments are connected to a wellhead through the other high-low pressure manifold, the instrumentation is used for remote control of the electric drive fracturing equipments and the electric drive sand blenders, wherein the gas turbine generator set comprises one gas turbine engine, one generator, multiple rectifying units and multiple inversion units, one end of the generator is connected to the gas turbine engine, the other end of the generator is connected to the rectifying units, and the generator is a double-winding generator, wherein the generator has a phase difference of double winding of 30°, and a winding configuration of type Y-Y or type D-D, and the generator outputs an alternating voltage ranging from 1600 VAC to 2300 VAC.

2. The wellsite system for electric drive fracturing according to claim 1, wherein the multiple rectifying units are arranged side by side, and the rectifying units and the inversion units are connected through a common DC bus.

3. The wellsite system for electric drive fracturing according to claim 1, wherein the gas turbine generator set is loaded on a semi-trailer, and inversion units are disposed on a gooseneck of the semi-trailer body.

4. The wellsite system for electric drive fracturing according to claim 1, wherein the electric drive fracturing equipments are loaded on semi-trailers, there are two electric motors and two plunger pumps in the electric drive fracturing equipment loaded on each semi-trailer, and each electric motor drives one plunger pump.

5. The wellsite system for electric drive fracturing according to claim 4, wherein each of the plunger pumps has a power of at least 5000 hp, and a stroke of at least 10 inches.

6. The wellsite system for electric drive fracturing according to claim 1, wherein the electric drive sand blenders each comprises a discharge centrifugal pump, a suction centrifugal pump, a first electric motor and a second electric motor, the first electric motor drives the discharge centrifugal pump, and the second electric motor drives the suction centrifugal pump.

7. The wellsite system for electric drive fracturing according to claim 6, wherein the first electric motor and the second electric motor are variable frequency integrated electric motors.

8. The wellsite system for electric drive fracturing according to claim 6, wherein the electric drive sand blenders are loaded on semi-trailers.

9. The wellsite system for electric drive fracturing according to claim 1, wherein the gas source is at least one of CNG, LNG, wellhead gas, and pipeline gas.

* * * * *